United States Patent [19]

Schmidt

[11] 4,046,542

[45] Sept. 6, 1977

[54] METHOD AND DEVICE FOR GRANULATING BLAST FURNACE SLAG

[75] Inventor: Kees J. Schmidt, Castricum, Netherlands

[73] Assignee: Hoogovens IJmuiden B.V., Ijmuiden, Netherlands

[21] Appl. No.: 672,619

[22] Filed: Apr. 1, 1976

[30] Foreign Application Priority Data

Apr. 7, 1975 Netherlands ..... 7504082

[51] Int. Cl.[2] ..... C03B 5/22

[52] U.S. Cl. ..... 65/19; 65/20; 65/141; 75/30; 122/235 N; 266/195

[58] Field of Search ..... 266/195, 201, 137, 187; 75/65 R, 24, 30; 65/19, 20, 141; 110/171; 122/235 N; 241/17

[56] References Cited

U.S. PATENT DOCUMENTS

| | | | |
|---|---|---|---|
| 1,115,321 | 10/1914 | Lessing | 65/19 |
| 3,912,487 | 10/1975 | Scharanov et al. | 65/19 |

FOREIGN PATENT DOCUMENTS

| | | | |
|---|---|---|---|
| 95,003 | 5/1920 | Switzerland | 65/19 |

*Primary Examiner*—Robert L. Lindsay, Jr.
*Attorney, Agent, or Firm*—Stevens, Davis, Miller & Mosher

[57] ABSTRACT

This invention relates to a method for granulating blast furnace slag, in which, by means of watersprays, slag which is supplied through a slag chute into an open explosion room, is first granulated, whereupon the water-granules mixture is transported to an open granulation pit and onto a dewatering bed, the dewatering granules being conveyed from said pit periodically.

6 Claims, 3 Drawing Figures

HO 246

HO 246

HO 246

METHOD AND DEVICE FOR GRANULATING BLAST FURNACE SLAG

A method and a device of this type are know, and are very attractive because they permit efficient and uninterrupted operation. In this known method the slag chute ends within the open explosion room above a second lower situated chute, and there are water sprays near the transfer point of the first chute to the second one. These watersprays as a rule are placed above and under the transfer point, which causes the slag to be granulated simultaneously and to be transported with high velocity by the second chute to the granulation pit.

During granulation the slag, which has a temperature of about 1400° C, a substantial part of the sprayed amount of granulating water evaporates, and this vapour escapes from the granulating pit. It has been found that various reactions of the granulating water with the slag, which almost always contains sulphur bound in one or other chemical manner, gives rise to the formation of volatile sulphur compounds, which are entrained in the water vapour. These volatile products mainly consist of $H_2S$ gas, thus causing serious nuisance to the environment. Also these products contain a substantial percentage of $SO_2$.

Various measures have been contemplated or tried out in order to reduce or even completely prevent this environmental nuisance, such as attempts to chemically bind the $H_2S$ gas which forms, by changing the chemical composition of the granulating water, or by catching the vapour which forms and washing the $H_2S$ gas therefrom. It has been found that it is almost impossible to affect the $H_2S$ formation by the addition of chemicals to the granulating water. Also it has been found impossible for practical reasons to catch all vapour which forms above the open granulating pit and the open explosion room, while washing the vapour shifts the environmental disadvantage from the environmental air to the surface water.

Tests were performed in order to neutralize the foul smell of the $H_2S$ gas by means of certain fragrants, but until now without success.

Also, it should be mentioned that there exist other granulating systems in which the blast furnace slag is carried into the interior of an enclosed space directly after its granulation by means of water. The water-granules mixture is then to be conveyed by means of a pump to an installation for separation of water and granules, and in order to prevent leakage of vapour to the exterior this installation is to be designed with a waterlock preventing escape of gas. The gases and vapours formed are conveyed away to the upper side, and again produce a $H_2S$ problem, although it is conceivable with this installation to convey the escaping gas directly to a gas washer. Although these granulating systems produce a granulate which is good in itself, they yet are more complicated in operation than the open granulating system mentioned above.

The invention consists in that in the known method the flow of the water-granules mixture, before debouching into the open granulating pit, is first carried, about at the location where the water vapour develops from the flow of the mixture, through an entrance opening into a vapour separating box which encloses the mixture flow, and in that the mixture flows through an exit opening in the bottom of the vapour separating box into the granulating pit, and in which the vapour developed is led from the upper side of the vapour separating box to a chimney which is sufficiently high to prevent nuisance to the surroundings. It is remarked that this vapour separating box should not be confused with the above described closed granulating systems, as according to the method of the present invention granulation takes place outside the vapour separating box, and the box only functions to separate vapour and water-granules mixture within a restricted space. In the event of an explosion during granulation this explosion will take place in the open explosion room and cause little or no material damage.

It is found that according to this method it is very feasible, possibly with the aid of an extra fan, to convey the vapour mixture containing $H_2S$ gas through a high chimney sufficiently far up into the atmosphere to prevent nuisance to the environment from the entrained $H_2S$ gases.

As the slag is granulated by means of a very powerful spraying system, which to a substantial degree also serves for the horizontal transport of the granulated slag, it is well possible to spray the granulate-water mixture sufficiently fast into the vapour separating box that the actual vapour formation only takes place inside the vapour separating box. Furthermore, as the entrance opening encloses the mixture flow, it is also prevented that a substantial part of the vapour escapes again through this entrance opening.

The installation which is used for performing the method according to the invention comprises in a manner known per se a slag chute which debouches into an open explosion room, a second, lower situated chute near the delivery point of the first chute, a spraying system, and an open granulating pit, into which the second chute debouches, said granulating pit comprising a dewatering bed and conveying means for the dewatered granulate. This device further is characterized according to the invention by the presence of a closed vapour separating box near the end of the second chute, said vapour separating box comprising an entrance opening into which the second chute debouches, an exit opening in the bottom directed towards the granulating pit, and an opening in the roof which connects to a high chimney.

According to a preferred embodiment, of this installation, according to the invention the vapour separating box widens near the entrance opening in two horizontal directions, narrows again in the upward direction gradually to the chimney connection, and narrows severly in the downward direction toward the exit-opening which is formed sufficiently narrow that during operation the widened part of the box serves as a waterlock against the escape of vapour through the entrance and exit openings. Good results have been achieved with an exit-opening which has in cross-section a surface area of 30 to 40% of the largest horizontal cross-section through the vapour separating box. It is hereby achieved that the granules mixture may flow away fast without the formation of build-ups in the system, whereas sufficient residence in the box is obtained that this box itself functions as a waterlock.

It is of importance that vapour only forms inside the vapour separating box. To this end the second chute should not be too long, whereas on the other hand it should not be so short that the mixture is injected with too high an impulse into the vapour separating box, thereby making it impossible that said box functions as a waterlock. It was found to be advantageous to design the second chute with a length of less than 3.5 m, and preferably of about 3 m.

It will be clear that the shape of the box defines the flow pattern of the water granules mixture, as well as of the vapour inside the box. Satisfactory results were obtained when the vapour separating box at the location of the entrance had the shape, in horizontal cross-section of a rectangle, which at the side away from the entrance opening is covered by a triangle, the heights of the triangle and of the rectangle being about similar, and the other side of the rectangle having about twice the length.

The invention is now explained by three figures.

Figure 1:
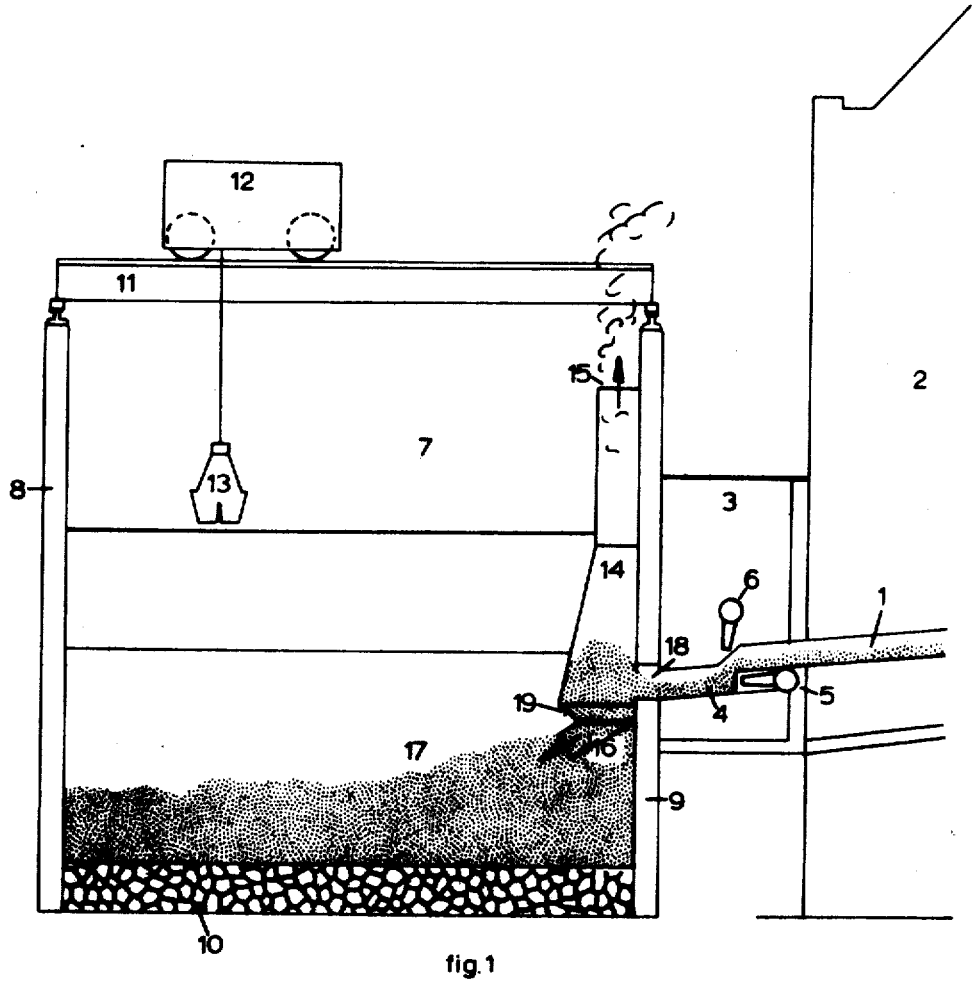
FIG. 1 shows a view of the entire installation schematically.

In FIG. 1 reference number 1 indicates a slag chute which from the cast house of a blast furnace 2 debouches into an explosion room 3, and there delivers into a second chute 4. Near the delivery location there is a horizontal spray 5 under slag chute 1, and a water spray system 6 which is directed obliquely downwardly above the delivery location.

The second chute 4 ends in the wall 9 of a granulating pit 7. The bottom of this granulating pit is formed by a dewatering bed 10, which mainly consists of layers of grit with dewatering tubes in said layers (not shown).

Across two separated parallel walls 8 and 9 of the granulating pit 7 a travelling crane 11 may travel, and on top thereof a travelling crab 12. By means of the travelling crab 12 a grab 13 may be operated, which periodically takes the dewatered granules from the bottom.

Figure 2:
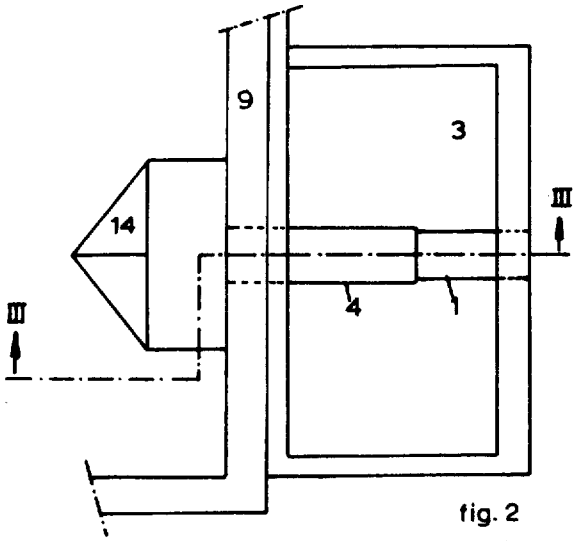
FIG. 2 is a detail from above.
Figure 3:
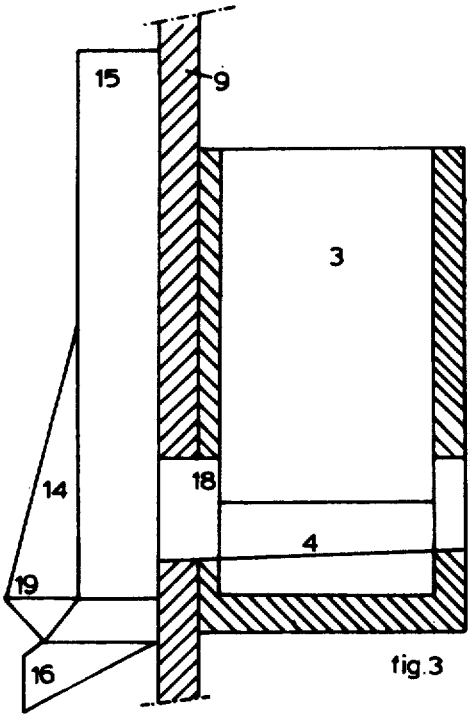
FIG. 3 is a cross-section according to III—III in FIG. 2.

Against wall 9 a vapour separating box 14 is mounted. This vapour separating box is shown in more detail in FIGS. 2 and 3. It comprises a widest intermediate part 19, which narrows gradually upwardly into vapour channel 15, and it further contains a discharge opening 16. Through the discharge opening 16, the granules-water mixture flows in a flow 17 onto the bottom of the pit. The mixture is injected through opening 18 in wall 9 into the vapour separating box, within which the vapour develops and separates from the mixture. In the Figure it is not indicated how the vapour escaping from opening 15 is led away. It will be clear to one with knowledge of the art how such an opening 15 should be connected to a high chimney next to the pit.

It has been found that it is possible to produce good quality granulate from blast furnace slag by means of the installation described. Also the environmental nuisance caused by $H_2S$ gases may be substantially limited. An important advantage of the new installation is that its investment costs are low, and that it requires almost no maintenance.

I claim:

1. In a method of granulating blast furnace slag comprising passing slag through a slag chute into an open explosion room, spraying said slag upon entry into said explosion room with water to granulate the slag and form a water-granules mixture, transporting said water-granules mixture to an open granulation pit and onto a dewatering bed to dewater the granules, and removing periodically said dewatered granules from said pit, the improvement which comprises flowing the water-granules mixture before debouching into the open granulating pit, through an entrance opening into a vapour separating box which encloses the mixture flow, flowing said mixture through an exit-opening in the bottom of the vapour separating box into the granulating pit, and leading the developed vapour from the upper side of the vapour separating box to a chimney.

2. A device for granulating blast furnace slag comprising an open explosion room, a first slag chute which debouches into said open explosion room, a second slag chute positioned lower than said first chute near the delivery point of said first chute, a spraying system, a closed vapour separating box positioned near the end of said second chute, an open granulating pit, into which the second chute debouches and a chimney, said granulating pit comprising a dewatering bed and conveying means for the dewatered granulate, said vapour separating box comprising an entrance opening into which the second chute debouches, an exit-opening in the bottom, directed towards the granulating pit, and an opening in the roof which connects to said chimney.

3. The device according to claim 2 wherein the vapor separating box near the entrance opening widens in two horizontal directions, narrows again upwardly gradually to the chimney connection, and narrows sharply downwardly toward the exit opening which is formed sufficiently narrow that during operation the widened part of the box serves as a waterlock against the escape of vapour through the entrance and exit openings.

4. The device according to claim 2 wherein the exit opening has in cross-section a surface-area of 30 to 40% of the largest horizontal cross-section through the vapour separating box.

5. The device according to claim 2 wherein the second chute has a length of less than 3.5 m.

6. The device according to claim 2, wherein the vapour separating box at the point of entrance of the slag has the shape, in horizontal cross-section, of a rectangle, which at the side away from the entrance opening is covered by a triangle, one dimension of the triangle and of the rectangle being about the same whereas the other dimension of the rectangle is about twice the first dimension.

* * * * *